United States Patent [19]

Anderson

[11] 4,372,339

[45] Feb. 8, 1983

[54] YARD HYDRANT

[75] Inventor: Stephen J. Anderson, Storm Lake, Iowa

[73] Assignee: Merrill Manufacturing Company, Storm Lake, Iowa

[21] Appl. No.: 210,670

[22] Filed: Nov. 26, 1980

[51] Int. Cl.[3] ..... E03B 9/04; E03B 9/14

[52] U.S. Cl. ..... 137/288; 137/292; 137/307; 137/383; 222/453; 251/324; 285/355

[58] Field of Search ..... 137/272, 281, 286, 287, 137/288, 299, 304, 307, 291, 292, 383; 285/333, 334, 355; 222/453; 251/324, 318, 319

[56] References Cited

U.S. PATENT DOCUMENTS

| | | | |
|---|---|---|---|
| 112,825 | 3/1871 | McCann | 137/272 |
| 1,050,033 | 1/1913 | Martin | 137/307 |
| 1,303,472 | 5/1919 | Haas | 137/307 |
| 1,693,095 | 11/1928 | Ritchie et al. | 137/272 |
| 2,649,111 | 8/1953 | Anderson | 137/304 |
| 3,070,116 | 12/1962 | Noland et al. | 137/302 |
| 3,244,192 | 4/1966 | Noland | 137/302 |
| 3,285,273 | 11/1966 | Noland | 137/272 |
| 3,504,694 | 4/1970 | Noland | 251/214 |
| 3,523,549 | 8/1970 | Anderson | 137/288 |
| 3,658,368 | 4/1972 | Hokanson | 285/355 |
| 3,672,392 | 6/1972 | Anderson | 137/288 |
| 3,858,599 | 1/1975 | Carlson | 137/307 |
| 4,003,669 | 1/1977 | Fenske | 285/355 |

*Primary Examiner*—George L. Walton
*Attorney, Agent, or Firm*—Morton S. Adler

[57] ABSTRACT

A yard hydrant includes an improved valve assembly connecting the hydrant standpipe at a point below the frost line to a source of water under pressure. A hollow and generally cylindrical housing of such assembly is provided with a bore concentrically reduced relative to the diameter of the housing and having an upper plane spaced inwardly from the upper end of the housing to receive a rod mounted and handle operated valve. The bore terminates at its lower end in a valve seat defining a further concentrically reduced access opening to the water supply. In spaced concentric relationship about the bore are a plurality of water passageways each in communication with said bore and each extending from the upper plane thereof for communication with the standpipe to a point spaced above the valve seat so that the bore is full circle only intermediate the valve seat and the lower limits of the passageways. A drain hole is provided through the housing to the bore near the upper plane thereof. The seated valve shuts off the water supply and exposes the drain hole for water drainage to the surrounding ground from the standpipe and in the opening of the valve, water cannot flow to the standpipe until the valve has not only moved off of the valve seat but has moved beyond the full circle bore area to expose the lower end of the water passageways to communication with the source of water and at which time, the valve has closed the drain hole to prevent escape of incoming water at that point so that all of such water flows directly to the standpipe and nozzle. The design of the housing makes possible the use of plastic materials for economy in manufacture and efficiency in operation.

6 Claims, 7 Drawing Figures

YARD HYDRANT

BACKGROUND OF THE INVENTION

This invention relates to yard hydrants and more particularly to an improved valve housing and valve assembly operable relative to the inlet flow to the hydrant nozzle and the outlet drainage from the standpipe.

This invention is also concerned with improved design features for a yard hydrant valve housing and valve assembly affording high efficiency in operation and especially suitable to fabrication from plastic materials for economic advantages in a competitive market.

The basic hydrant art goes back many decades and the development of the individual yard hydrant is exemplified in U.S. Pat. Nos. 2,649,111, 3,523,549 and 3,672,392. Characteristically, the yard hydrant includes a valve below the frost line for delivering water from a supply pipe through a standpipe to an above ground nozzle head and has a drain hole in the valve housing so that when the valve is closed, water in the standpipe can drain to surrounding ground and thus not freeze in the pipe in cold weather. In such cases, the valve functions, when open, to close the drain hole and, when closed, to open the drain hole. U.S. Pat. Nos. 3,926,206 and 3,926,207 illustrate yard hydrants without drain holes but with self-contained reservoir means for containing drainage from the standpipe. The present invention is concerned with yard hydrants utilizing the drain hole structure.

The market for yard hydrants is highly competitive and while the efficiency of such devices is highly developed, they have been relatively expensive to manufacture especially when made of metal as has been the traditional material used. U.S. Pat. No. 3,523,549 discloses one endeavor in yard hydrants designed for the use of plastic materials and one of the important objects of the present invention is to provide improved design features for the use of such materials in the yard hydrant valve housing to further increase the economies in manufacture and at the same time to improve the efficiency and trouble free operation thereof.

More particularly, it is an object herein to provide a yard hydrant valve housing of the above class that includes a valve receiving bore having a lateral drain hole and with the bore surrounded by spaced communicating water passageways in a novel arrangement whereby the opening and closing of the valve alternately opens and closes the drain hole and passageways.

A further object is to provide a yard hydrant valve assembly as characterized which does not require the use of conventionally used removable components such as springs, cup washers, 0-rings and the like.

The foregoing objects and such further objects as may appear herein, or be herinafter pointed out, together with the advantages of this invention will be more fully discussed and developed in the more detailed description of the accompanying drawings.

DESCRIPTION OF THE PREFERRED EMBODIMENT

Figure 1:
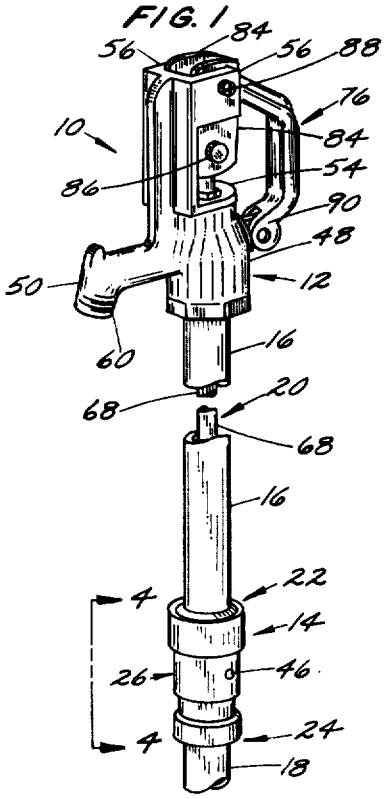
FIG. 1 is a perspective foreshortened view of this yard hydrant ready for use.
Figure 7:
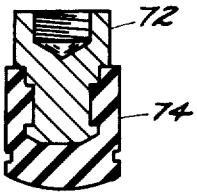
FIG. 7 is a cross sectional view of the valve head taken on line 7—7 of FIG. 2.

Referring to the drawings, this new yard hydrant is designated by the numeral 10 and includes, generally, the vertically spaced head section 12 and valve housing 14 connected by a standpipe 16 of indeterminate length, it being understood that housing 14 will be disposed below the frost line for connection to a standard water main pipe 18 through which water is supplied under pressure and the head section 12 will be disposed above ground level. A valve stem assembly 20 is operable between head section 12 and valve house 14 within the standpipe 16 and details of such components are further described as follows.

Figure 5:
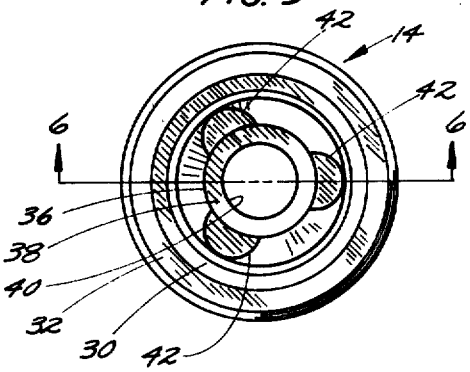
FIG. 5 is a top view of the valve housing taken from the line 5—5 of FIG. 4.
Figure 4:
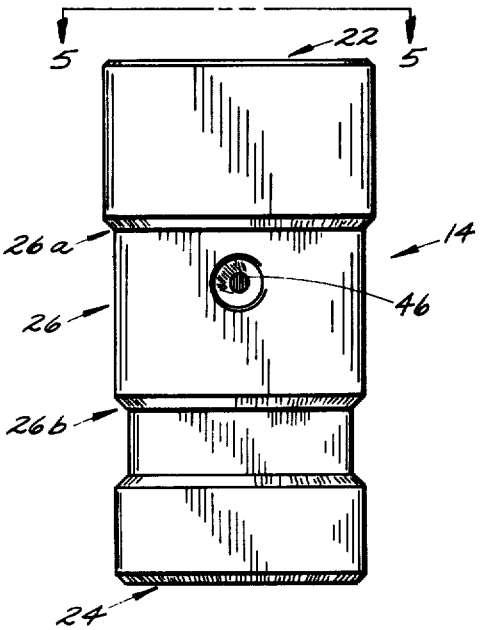
FIG. 4 is an enlarged elevational view of the valve housing taken from the line 4—4 of FIG. 1.
Figure 6:
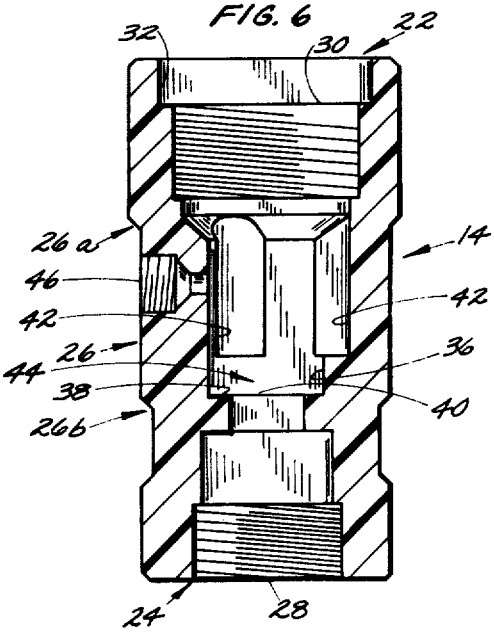
FIG. 6 is a cross sectional view of the valve housing taken on the line 6—6 of FIG. 5.

Valve housing 14, as best seen in FIGS. 4–6, represents the more important feature of this invention by reason of its novel design as will appear and provides a highly efficient valving operation requiring a minimum of associated parts in a form that is extremely economical to manufacture particularly from plastic materials although it will be understood that other materials may also be used.

Housing 14 is an elongated generally cylindrical hollow fitting having a top end 22, a bottom end 24 and a central section 26 defined by an upper limit **26*a* and a lower limit 26*b*. The bore 28 at housing end 24 is internally threaded for attachment to supply pipe 18 and the bore 30 at housing end 22 is similarly threaded for attachment to the lower end of the standpipe 16 to provide fluid flow communication from pipe 18 through pipe 16 to the head section 12 as will later appear in more detail. One of the improved features on housing 14 is at the top end 22 where the top plane of the threaded portion of bore 30 is spaced inwardly from end 22 to provide the projecting housing wall extension 32 designed to encircle any exposed threads on standpipe 16 as best seen in the lower portions of FIGS. 2,3. By this arrangement, a suitable sealant (not shown) can be applied in the space 34 intermediate the standpipe threads and wall extension 32. The purpose here is to protect any exposed threads on standpipe 16** from the elements and particularly if the standpipe is of metal where such exposed threaded portions are susceptive to rusting.

Figure 2:
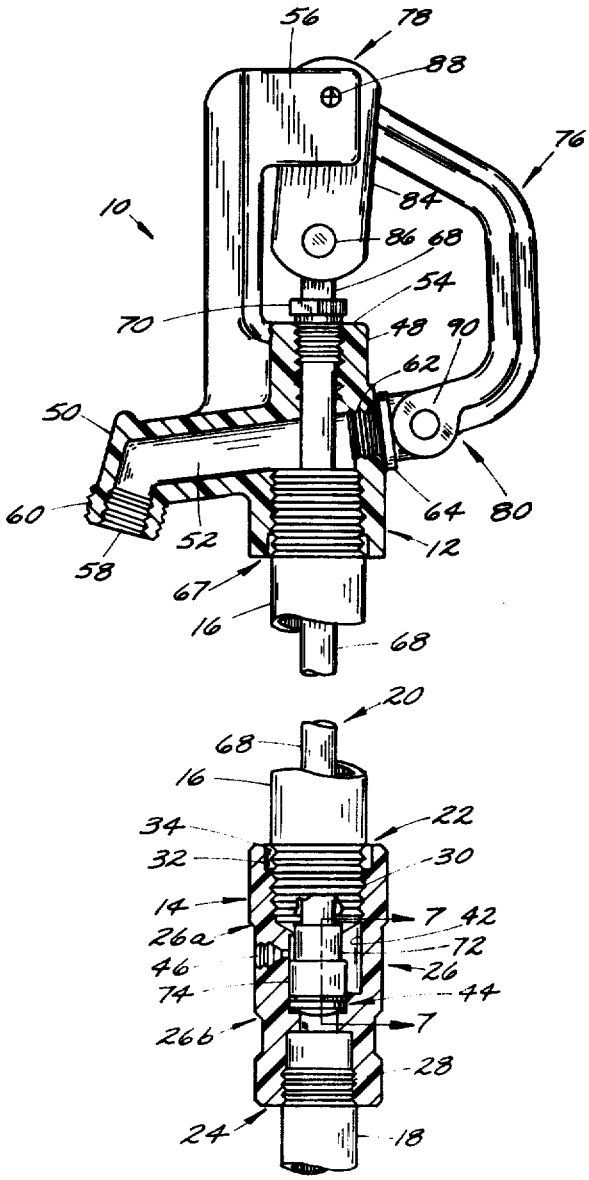
FIG. 2 is an enlarged cross sectional view of the device in FIG. 1 showing the valve closed and the drain hole open.

In the central section 26 of housing 14 between the top and bottom limits, **26*a*, 26*b*, there is the valve head receiving bore 36 which is reduced in diameter relative to the bore 28 at end 24 and the bore 30 at end 22. bore 36 terminates at its bottom end in the valve seat 38 surrounding a further concentrically reduced water access opening 40 in flow communication with supply pipe 18. In spaced concentric relationship about the valve head bore 36 there are a plurality of water passageways 42 each in communication with bore 36. Each passageway 42 communicates at the upper end of bore 36 at limit 26*a* of the central section 26 with bore 30 in communication with standpipe 16** and each passageway 42 terminates at its lower end at a plane spaced upwardly from valve seat 38 so that while passageways 42 interrupt the wall surface of bore 36 for the major length thereof, such bore is full circle for a predetermined distance between the lower end of the passageways 42 and valve seat 38 as best seen in FIG. 6 and designated generally by the numeral 44. It will also be noted that the respective passageways 42 are within an area of lesser diameter than the diameter of the threaded portion of bore 30 as seen in FIG. 2 and this provides important advantages in economy of manufacture by permitting the full circle area and water passageways to be formed not only by injection molding processes as distinguished from the traditional hydrant casting methods but also to eliminate the machining of the axial bore and the full circle area which is normally required when the products are cast. A drain hole 46 in housing 14 extends through section 26 to communication with bore 36.

Head section 12 is of a well known construction and includes the integral jacket head chamber 48, nozzle 50 with water channel 52, a U shaped open portion that has a bottom surface 54 in common with the top surface of chamber 48 and two spaced apart bearing ears 56 above the U shaped portion to form the top of section 12. The dispensing end of nozzle 50 is preferably threaded both inside 58 and outside 60 for convenient attachment to a hose, if desired. Head section 10, as shown, being preferably made of plastic materials is formed with the side hole 62 when a core forming water channel 52 is removed, as is well known, and such hole is closed by the removable plug 64 that is provided with an apertured ear 66 seen in FIG. 3. The lower portion of chamber 48 threadably receives the top end of standpipe 16 as shown and is designed as at 67 for protection of the standpipe threads in a manner similar to that described for housing 14 at end 22.

The valve stem assembly 20 includes a valve stem 68 disposed for vertical reciprocation within standpipe 16 so that its lower end extends into housing 14 and its upper end extends through a standard water-tight gland fitting 70 in head chamber 48 to a point above surface 54. The lower end of the valve stem 68 carries a removable valve head 72 encased in a molded rubber tip 74 and is operable in bore 36 of housing 14 as will later be explained in more detail.

Figure 3:
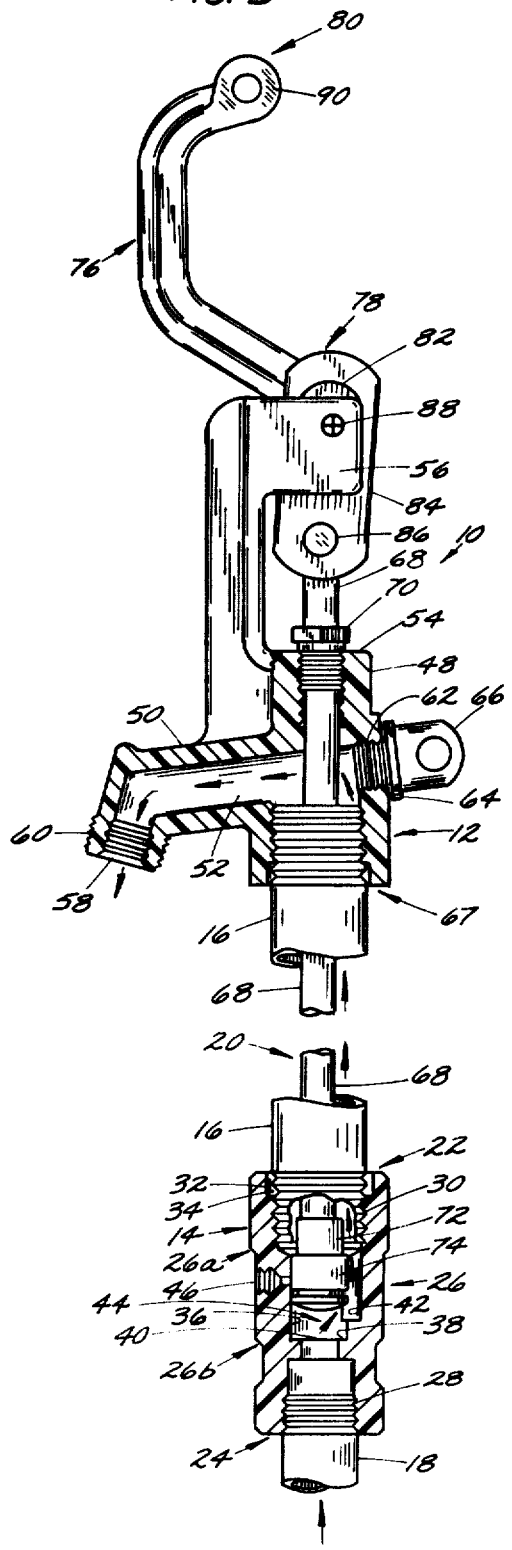
FIG. 3 is an enlarged cross sectional view similar to FIG. 2 but showing the handle elevated to open the valve and close the drain hole.

A valve operating handle 76 is shaped as seen in FIGS. 2,3 and has an upper end 78 and a lower end 80 with the sides at the upper end 78 being flat and machined to provide opposed laterally projecting stub shafts 82. End 78 of handle 76 is disposed intermediate bearing ears 56 where a pair of flat elongated rectangular rigid strap links 84, each having holes at respective end portions, are engaged at corresponding ends with the respective shafts 82 so as to depend in parallel relationship where their lower ends are secured to an appropriate fitting represented at 86 that is operably secured to the upper end of the valve stem 68. Shafts 82 are eccentrically and rotatably arranged between ears 56 by a suitable fastener 88. The lower end 80 of handle 76 is provided with a pair of spaced apertured ears 90 adapted to register with the ear 66 on plug 64 when the handle 76 is in closed position.

OPERATION

The closed or "off" position of handle 76 and valve head 72 is shown in FIG. 2 and the open or "on" position thereof is shown in FIG. 3. When closed, the rubber tip end 74 of valve head 72 is in fluid seal engagement on seat 38 with opening 40 and in similar engagement with the full circle area 44 of bore 36 below the water passageways 42. Also, when closed, the valve end 74, which is the only part of the valve head 72 to engage bore 36, is below the drain hole 46 so that any water in standpipe 16 remaining when the water flow is shut off can drain through hole 46 to the surrounding area.

As handle 76 is raised towards the position in FIG. 3, the valve stem 68 moves upwardly to remove valve end 74 from the water access opening 40 which permits flow through such opening but restricts such flow further as long as valve end 74 is in engagement with the bore 36 at the full circle area 44. During the time that valve end 74 is engaged with bore 36 at area 44, the upper limits of the rubber covered portion of the valve head will close the drain hole 46 before valve end 74 clears area 44 and the continued elevation of the valve stem 68 will raise valve end 74 above the lower limits of passageways 42 to establish flow communication for water from opening 40 through standpipe 16 and to nozzle 50. As handle 76 is lowered, the lower end of valve end 74 will reach bore area 44 to close off flow communication to passageways 42 as drain hole 46 is opened to communication with water in the standpipe 16.

It will be appreciated that the elevation of valve end 74 progressively increases the passageway 42 area exposed to water flow from opening 40 so that the volume of flow can be controlled according to the position at which handle 76 is placed. Such a control feature, per se, is not new as seen in U.S. Pat. No. 2,649,111 and in the present invention I have used a handle construction similar to such patent but have accomplished the control objective for the water flow in a novel manner by reason of the improved valve housing 14 and valve head 72 as described which requires fewer parts. Has great efficiency, is more economical to manufacture and is substantially trouble free in operation.

In the closed position of the handle 76 as seen in FIG. 2, the registration of ears 90 on handle 76 with ear 66 on plug 64 provides means for use of a padlock (not shown), if desired, to secure the handle 76 against unauthorized use. Accordingly, in view of the foregoing, it is thought a full understanding of the construction and operation of this invention will be had and the advantages of the same will be appreciated.

I claim:

1. In a yard hydrant of the class having a head chamber with integral nozzle, a standpipe secured at one end to said head chamber and secured at its other end to a valve housing adapted to be connected to a source of water under pressure, a valve assembly including a valve stem disposed in said standpipe and operable relative to said housing and means for operating said valve assembly, an improvement in said housing and valve assembly, comprising:

said housing being hollow having an upper internally threaded end for attachment to said standpipe, a lower end for attachment to said source of water supply and a central section defining a valve head receiving axial bore concentrically reduced relative to said upper and lower ends, said axial bore terminating in a valve seat concentric with a water passageway to said lower end, a water flow channel within said housing and within an area of lesser diameter than the upper internally threaded end of said housing communicating with said axial bore from a point spaced a predetermined distance above said valve seat and extending therefrom to communication with said upper end, said axial bore having a full circle area only intermediate said valve seat and the lowermost limit of said water flow channel, a drain hole in said housing communicating with said axial bore, a valve head on said valve stem disposed in fluid seal engagement in said axial bore, and the means for operating said valve assembly effecting the reciprocation of said valve stem whereby in closed position, said valve head is in fluid seal engagement with said valve seat and said full circle area below said drain hole to open said hole to communication with said axial bore and said upper end and in the movement of said valve head off of said valve seat towards open position, water flow from said lower end through said water flow channel to said upper end, standpipe and nozzle is withheld while said valve head remains in the full circle area of said axial bore during which time said valve head registers with said drain hole to close the same before it has moved out of the full circle area to expose said water flow channel to communication with said lower end.

2. A yard hydrant as defined in claim 1 wherein the means for operating said valve assembly includes a handle member operably connected to said head chamber and said valve stem so that said valve head can be elevated to selected positions in said axial bore to progressively increase and decrease the area of said water flow channel exposed to flow communication with said lower end to regulate the volume of water flow therethrough.

3. A yard hydrant valve, comprising:

a hollow valve housing having an upper internally threaded end for attachment to a standpipe connected to a hydrant head and integral nozzle, a lower end for attachment to a source of water supply under pressure and a central section defining a restricted valve head receiving axial bore terminating in a valve seat in communication with said lower end, a drain hole in said housing communicating with said central section, a water flow channel in said housing adjacent and exteriorly of said central section and in communication with said upper internally threaded end, said water flow channel also in communication with said central section to interrupt the surface of said axial bore and such interruption extends from said upper end to a point spaced a predetermined distance above said valve seat whereby said axial bore has a full circle area only intermediate said valve seat and the lower limits of said water flow channel, said axial bore and said water flow channel each being in an area of lesser diameter than the diameter of the upper internally threaded end of said housing, an elongated valve head in fluid seal engagement in said central section and capable of registration with said drain hole, a valve stem secured to said valve stem and adapted to extend through the hydrant standpipe to the hydrant head to a means for effecting the reciprocation thereof, said valve head in closed position being in fluid seal engagement with said valve seat and said full circle area and out of registration with said drain hole to open the same to communication with said axial bore and said upper internally threaded end, in the movement of said valve head off of said valve seat towards the open position, one end portion of said valve head registers with said drain hole to close the same while the other end portion thereof remains in said full circle area of said axial bore to restrain water flow at such point, and continued movement of said valve head raises it above said full circle area to expose said water flow channel and permits water from said lower end to flow therethrough around said valve head to the standpipe and nozzle.

4. A yard hydrant valve as defined in claim 3 including a plurality of like water channels concentrically spaced about said axial bore to define a plurality of interruptions in the surface of said bore and each of said water channels being in an area of lesser diameter than the diameter of the upper internally threaded end of said housing.

5. A yard hydrant valve as defined in claims 3 or 4 including said drain hole communicating with said bore at a point other than the interrupted portions thereof.

6. A yard hydrant valve as defined in claims 1 or 4 or 5 including said valve housing being of plastic material.

* * * * *